United States Patent [19]

Moudgil et al.

[11] 4,352,731

[45] Oct. 5, 1982

[54] APPARATUS FOR SELECTIVE WETTING OF PARTICLES

[75] Inventors: Brij M. Moudgil, New York, N.Y.; John G. Roeschlaub, Upland, Calif.

[73] Assignee: Occidental Research Corporation, Irvine, Calif.

[21] Appl. No.: 220,656

[22] Filed: Dec. 29, 1980

Related U.S. Application Data

[63] Continuation-in-part of Ser. No. 203,738, Nov. 3, 1980, abandoned, which is a continuation of Ser. No. 897,946, Apr. 19, 1978, abandoned.

[51] Int. Cl.[3] ..... B03B 1/00

[52] U.S. Cl. ..... 209/9

[58] Field of Search ..... 209/3, 4, 9, 166, 3.1; 427/424, 220

[56] References Cited

U.S. PATENT DOCUMENTS

| | | | |
|---|---|---|---|
| 1,094,760 | 4/1914 | Terry | 209/9 X |
| 1,678,884 | 7/1928 | Sweet | 209/4 X |
| 1,975,902 | 10/1934 | McConnaughey | 427/220 |
| 2,222,176 | 11/1940 | Linke | 209/3 |
| 2,245,200 | 6/1941 | Johnson | 209/9 |
| 2,564,546 | 8/1951 | Scheu | 209/166 |
| 2,707,690 | 5/1955 | Pearson | 427/424 X |
| 2,751,079 | 6/1956 | Ahlmann | 209/380 X |
| 2,769,536 | 11/1956 | Fraas | 209/9 |
| 2,997,171 | 8/1961 | Sansel | 209/4 |
| 3,033,363 | 5/1962 | Weston | 209/166 X |
| 3,202,281 | 8/1965 | Weston | 209/166 |
| 3,254,762 | 6/1966 | Smith | 209/166 X |
| 3,335,022 | 8/1967 | Sincock | 427/424 X |
| 3,346,111 | 10/1967 | Thompson | 209/9 |
| 3,356,211 | 12/1967 | Mathews | 209/3.1 |
| 3,400,011 | 9/1968 | Fox | 427/220 |
| 3,477,842 | 11/1969 | Cook | 71/28 |
| 3,710,933 | 11/1973 | Fulwyler | 209/4 |
| 3,900,393 | 8/1975 | Wilson | 209/399 |
| 3,900,628 | 8/1975 | Stewart | 209/399 X |
| 3,901,793 | 8/1975 | Buchot | 209/9 X |
| 4,148,941 | 4/1979 | Pape | 427/220 |

FOREIGN PATENT DOCUMENTS

| | | | |
|---|---|---|---|
| 250039 | 8/1911 | Fed. Rep. of Germany | 209/9 |
| 520493 | 5/1924 | France | 209/9 |
| 430894 | 4/1973 | U.S.S.R. | 209/3 |

OTHER PUBLICATIONS

Abstract 2799, Fraas, 7/50, Electrostatic Seperation, Garnet and Diapside.

*Primary Examiner*—Tim R. Miles
*Attorney, Agent, or Firm*—Walter A. Hackler

[57] ABSTRACT

Apparatus and method for selective wetting of particles includes sizing of particles to a preselected size for enabling optical discrimination between desired particles having a relatively large surface area receptive to coating by a preselected wetting agent and undesired particles having a relatively small surface area receptive to coating by the preselected wetting agent. The particles are fed into a conditioning zone defined by the spray of wetting agent from at least one spray means, the spray of wetting agent being in sufficient quantity to impact and coat substantially all of the surface areas of the particles receptive to coating by the wetting agent. The means for feeding the particles into the conditioning zone is disposed outside the conditioning zone and preferably feeds the particles in an unsupported state into the conditioning zone.

4 Claims, 1 Drawing Figure

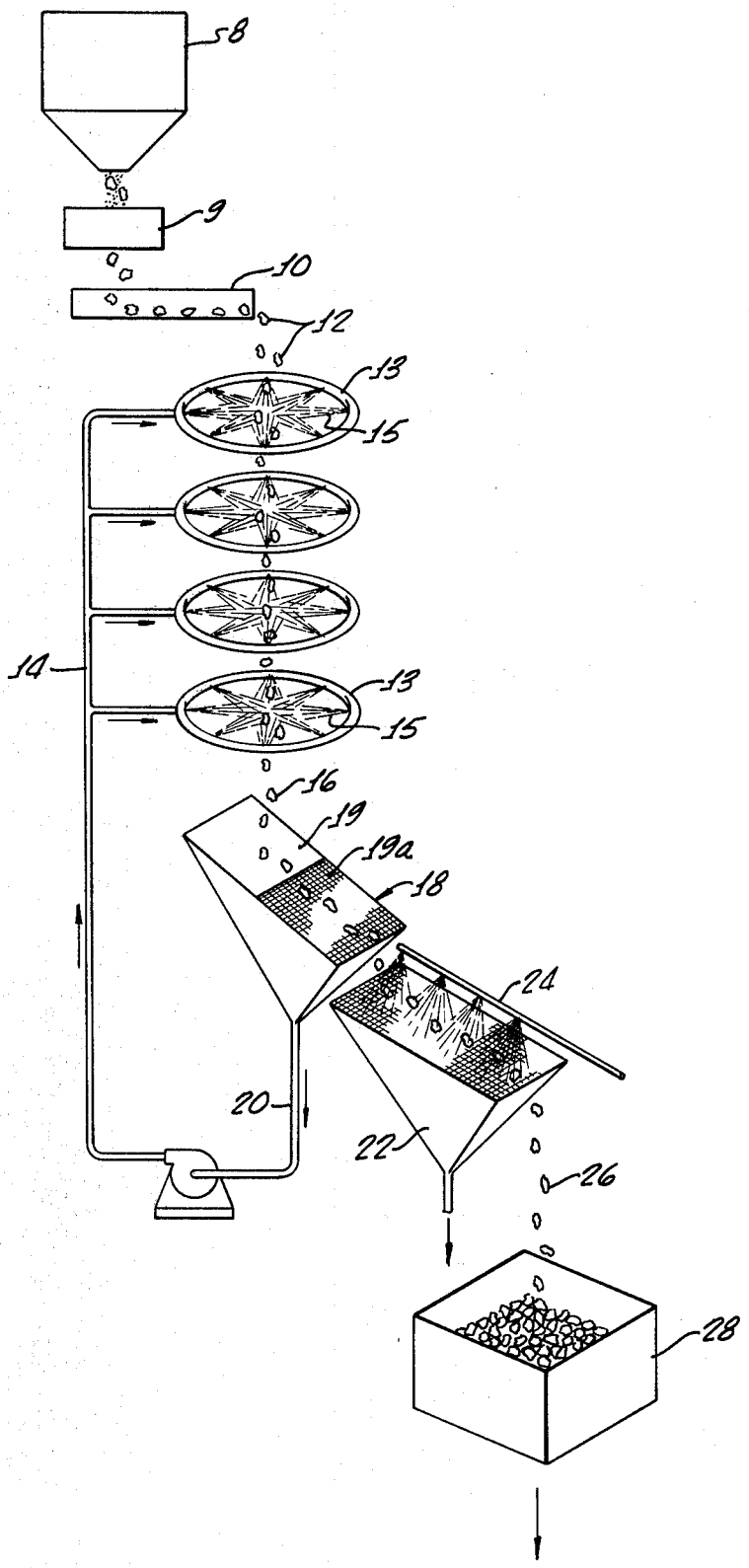
8
9
10
12
13
15
14
13
15
16
19
19a
18
24
20
22
26
28

APPARATUS FOR SELECTIVE WETTING OF PARTICLES

CROSS REFERENCE TO RELATED APPLICATIONS

This application is a continuation-in-part of Ser. No. 203,738 filed Nov. 3, 1980, now abandoned, which is a continuation of Ser. No. 897,946, filed Apr. 19, 1978, now abandoned, the entire disclosure of the parent application being hereby incorporated herein.

BACKGROUND OF THE INVENTION

The present invention relates to a method for conditioning a mixture of particles with a surface active reagent and to apparatus for performing the method of this invention. More particularly, this invention relates to a method for selectively wetting surface areas of particles which are receptive to coating by a preselected wetting agent or surface active reagent.

Selective wetting of particles is required for many operations for separating a mixture of particles. In particular, the selective wetting of particles is practiced in the mining and ore beneficiating art for separating minerals from the ore in which it is contained. Some methods used to separate a mineral from the other components within a mineral ore rely on the differences in the surface chemical properties of the components in the ore. The surface chemical properties of a particle of ore depend upon components present in that particle of ore. As the particles contain varying compositions, desired particles can be distinguished and thereby separated from undesired particles according to their composition, through use of the surface chemical properties of the individual particles.

In order to make use of the differences in the surface chemical properties of the particles of ore, it is often necessary to contact the mixture of particles with a surface active reagent that will selectively react with some surface portions of the particles due to the selectivity of the reagent in distinguishing between surface chemical properties. The term "react" within the context of the present invention is meant to be a chemical reaction, a physical reaction, or a combination thereof as applicable to the surface areas of particles under consideration herein.

The process of contacting a mixture of particles with a surface active reagent is referred to in the art as "conditioning." Methods of particle separation in which it is necessary to condition the particles include methods such a flotation separation and optical separation. In flotation separation the particles to be separated are conditioned with a flotation agent. However, this process is typically limited to small particles which can be "floated" in a medium. A major disadvantage in this process is the cost and energy required to reduce the ore to a suitable size for flotation.

In a fluorescent, or optical separation method, the mixture of the particles to be separated may be conditioned with an aqueous dispersion of a suitable surface-active reagent and a fluorescent material (e.g. a dye). The coated surface areas on the particles exhibit fluorescence when exposed to electromagnetic radiation, such as ultraviolet light. Particles poorly coated with the surface active reagent do not exhibit significant fluorescence when exposed to electromagnetic radiation and hence are distinguishable from particles having larger coated surface areas. Based on the difference in fluorescence, coated particles can be effectively separated from those which are poorly coated in a machine as designated in Mathews U.S. Pat. No. 3,472,375; U.S. Pat. No. 3,356,211; U.S. Pat. No. 3,722,676 (all of which are incorporated herein).

The methods currently employed for conditioning particles generally consist of either one of two conditioning methods. One current method practiced includes submerging the mixture of particles to be separated in a fluid bed containing the surface active reagent. A disadvantage of such a method is that a large reservoir of the surface-active reagent is necessary to continuously wet the mixture of particles as the particles move through the fluid bed. Another disadvantage of such a method is that all surface portions of the particles receptive to the surface-active reagent may not be coated because of contact of the particle with the transfer device which conveys the particle through the fluid bed. This partial coating of the particle may inhibit the efficient separation of the particles from the mixture because all surface areas receptive to coating should be coated to effect efficient later separation of the particles.

A second method of wetting a mixture of particles includes spraying the surface active reagent onto the mixture of particles as the particles move on a conveyor belt or a vibrating screen. In this method, however, the particles also may not have all the surface portions thereon receptive to the surface-active reagent coated because of particle contact with the belt. Even if the belt were vibrating some surfaces receptive to surface-active reagent may not be coated by the reagent. As the particles are also in contact with a surface, there may also be smearing of the surface-active reagent on the particle and on the particles that are not normally surface chemically active with the reagent.

SUMMARY OF THE INVENTION

In accordance with the present invention, a method for conditioning a particle mixture comprising desired and undesired particles, for enabling optical distinction between the desired particles and the undesired particles comprised the steps of: sizing said desired and undesired particles to a predetermined size, said desired particles having a relatively large surface area receptive to coating by a preselected wetting agent and said undesired particles having a relatively small surface area receptive to coating by the preselected wetting agent, said relatively large surface area and said relatively small surface area being optically distinguishable after being coated by the preselected wetting agents; passing the particle mixture comprising the desired and undesired particles through a conditioning zone; and impacting said desired and undesired particles within the conditioning zone with sufficient wetting agent to substantially coat all of the desired and undesired particle surface areas receptive to coating by the wetting agent.

Also in accordance with the present invention, apparatus for practicing the method includes means for sizing said desired and undesired particles to a predetermined size, said desired particles having a relatively large surface area receptive to coating by a preselected wetting agent and said undesired particles having a relatively small surface area receptive to coating by the preselected wetting agent, said relatively large surface area and said relatively small surface area being optically distinguishable after being coated by the preselected wetting agent; spray means defining a conditioning zone, for impacting said desired and undesired particles with sufficient wetting agent to substantially coat all of the desired and undesired particles' surface areas receptive to coating by the wetting agent within the conditioning zone; and, feeding means for passing the particle mixture comprising the desired and undesired particles through the conditioning zone in an unsupported state.

BRIEF DESCRIPTION OF THE DRAWING

These and other aspects of this invention will be more fully understood by reference to the following detailed description and accompanying drawing which schematically shows an embodiment of the apparatus for carrying out the method of this invention. The drawing shows particles being fed to a conditioning zone which is defined, or established, by a plurality of spray nozzle arrangements. Thereafter the particles are drained, and transferred to a washing stage of the conditioning process.

DETAILED DESCRIPTION OF THE INVENTION

According to the present invention, there is provided a method for the conditioning particles with a preselected wetting agent such as a surface active reagent and an apparatus useful in the practice of this invention. The term "wetting agent" is used herein to include all reagents which selectively coat or react with, surface portions of a particle which are receptive to such coating. The practice of the method and apparatus of this invention may be used in combination with the practice of other processes wherein it is necessary to wet a particular particle within or undergoing such other process.

Particles to be conditioned in the practice of the method of this invention in the preparation for separation employing optical separation methods are first crushed to provide particles having a size of from about one-fourth inch to about eight inches. It is important that the particle size be sufficiently large to have surface areas receptive to coating that can be distinguished by optical methods. To insure proper size of particles, a screen may be used to grade the particles.

Following the crushing and sizing of the particles, the particles may be washed to substantially remove any fines from the particle mixture. Removal of fines from the mixture of particles generally prevents such fines from interfering with the coating action of the wetting agent on surface areas of the particles receptive to coating by the wetting agent. Fine removal also prevents such fines from forming a suspension with the wetting agent or the medium containing the wetting agent and thereby creating obstructions within the apparatus used or otherwise interfering with the method of wetting the particles.

The particles may be washed to remove fines by placing the mixture of particles on a vibrating screen, or the like, passing below a sprayer or series of sprayers which dispense a washing agent. The vibrating screen has a mesh sufficiently large that the washing agent washes the fines through the mesh but sufficiently small to prevent the particles passing therethrough. The vibration of the vibrating screen assists in removing substantially all the fines from the mixture of particles.

Following washing of the ore particles, the ore particles are fed to the conditioning zone by a conveyor. Such a means for feeding the particles to the conditioning zone in free fall may be a conveyor belt, or vibrating feeder (not shown). When a conveyor belt is utilized, the ore particles may depart the belt in a free fall trajectory towards the conditioning zone. Other means for feeding the mixture of particles to the conditioning zone may include a vibrating feeder whereby the particles are moved therealong because of the vibration of the feeder. As an alternative, the means used for washing the fines from the mixture of particles may include or be used for feeding the particles to the conditioning zone.

In the conditioning zone the particles are contacted with the wetting agent. The surface areas of the particles which are receptive to the wetting agent are then coated. The conditioning zone may include any means for delivering the wetting agent onto the mixture of particles as the particles fall through the zone as long as sufficient wetting agent is impacted with the particles to coat approximately all of the surface areas thereon receptive to coating by the wetting agent. Such means may include nozzle sprayers, ring sprayers, oscillating sprayers and the like. It is important to recognize that the movement of the particles through a mist or fog of wetting agent would not be effective in coating all of the particle surface areas receptive to coating because of the insufficient amount of wetting agent available in the mist or fog, to coat such areas. Hence, the use of a mist or fog of wetting agent would not produce sufficient coating on the particles to enable discrimination therebetween by optical methods.

A preferred means for delivering the conditioning agent includes at least one-ring type sprayer directed toward the freefalling particles. As the particles rotate and tumble in their free fall, the wetting agent sprayed from such a sprayer can coat substantially all the surface areas of each particle which are receptive to such coating. In a particularly preferred practice of the method of this invention, a plurality of wetting agent sprayers are arranged around the particles in free fall. The spray from each sprayer is directed inward of the ring toward the falling particles, the combination of spray defining the conditioning zone. Each of the sprayers is capable of delivering the wetting agent onto the surface of the falling particles. By using a plurality of sprayers arranged (as in a ring) around the particles, and by varying the direction of spray of the sprayers within the arrangement, the receptive areas on the particles can be substantially, uniformly and evenly coated with the wetting agent as they fall through the zone.

After passing through the conditioning zone, the mixture of particles is transferred to a separation stage of the conditioning process wherein the falling particles are caught by collecting means, such as a pan or screen having a mesh sufficiently small to catch the falling particles. The excess wetting agent on the particles or that excess which falls along with the particles can pass through the mesh of the screen and be collected. This wetting agent which is collected can be recycled to the conditioning zone for use in the wetting of other particles falling through the zone. The impingement of the falling particles on the collecting means assists in the removal of excess wetting agent from the particles.

The particles are then fed from the collecting means to a washing means for washing excess wetting agent from the particles and for rinsing off any wetting agent which can be entrained on non-receptive surfaces of the particles. Such a washing means can be a vibrating screen transporting the mixture of particles past a sprayer or series of sprayers which deliver a washing agent onto the particles.

Following the washing of the particles to remove the excess wetting agent, the particles may be collected for separation based upon the selectivity in the coating of the particles by the wetting agent.

The apparatus useful in the practice of this invention is illustrated in the accompanying drawing. After sizing by a crusher 8 and grading by a screen 9, or the like, sized mixture of particles 12 is delivered to a means 10 for feeding the particles by free fall to a conditioning zone 14 defined by the sprayer 15. Such a means for feeding the particles to the conditioning zone can be a vibrating feeder 10 as shown in the drawing. The mixture of particles tumbles off the edge of the vibrating feeder 10 because of the vibration and slope of the vibrating feeder. The stream of particles 12 falling from the vibrating feeder 10 pass through a conditioning zone 14. In the conditioning zone the particles are contacted with a preselected wetting agent such as a surface active reagent. The preselected wetting agent is selective in wetting a reception portion of the particle surface based upon the surface chemical properties of the particles. The wetting agent substantially coats those surface portions of the particles with which it is reactive to the substantial exclusion of coating those surface portions of the particles with which it is nonreactive.

It is to be appreciated that if the conveyor 10 is provided with an upwardly turned end (not shown) and the conveyor is run at sufficient speed, the particles may be launched, or propelled upwardly. If the conditioning zone is disposed for receiving such launched particles, the apparatus and method may be used in the manner of the present invention under the meaning of "free fall," that is, no physical contact of the particles with conveying, or transport equipment, occurs while the particles are traversing the conditioning zone.

The conditioning zone 14 contains at least one sprayer 13 directed toward the falling mixture of particles 12. In a preferred embodiment of the apparatus, the conditioning zone is a plurality of such sprayers forming a ring around the falling stream of particles 12. Each of the sprayers is directed inward of the ring providing a spray of the wetting agent toward the falling particles. In a particularly preferred embodiment of the apparatus of this invention, a plurality of sprayer rings 13, shown in the drawing, each having a plurality of sprayers 15, are vertically spaced apart enabling the falling stream of particles 12 to pass through each sprayer ring 13. The spray of each sprayer 15 is directed toward the falling stream of particles for defining the conditioning zone.

The stream 16 of particles is collected by collecting means 18 wherein excess wetting agent can be separated from the particles by impingement of the particles onto the collecting means 18 and collected for recycling to the conditioning zone.

Preferrably, the collecting means 18 includes means for preventing substantial breakage of the particles 16 upon impact therewith which may include an inclined surface member 19. Breakage of the particles is not desired because new surface areas would be exposed which were not impacted by wetting agent in the conditioning zone.

The inclined surface member may be coated with an impact absorbing material such as synthetic rubber, fiber, or foamed polyurethane. Preferably the impact absorbing material has a surface which is resistant to build-up of wetting agent thereon, or is covered with a thin film of material resistant to build-up of wetting agent such as Teflon or Adroprene.

After impact with the inclined member 19 the particles pass onto a screen 19A which may be any type of grid, perforated plate, or corrugated member which enables the excess wetting agent to flow through but prevents passage of the particles. The excess wetting agent collected in collection means 18 is transported via recycle line 20 for recycling to the conditioning zone 14.

The collected particles are transported from the collecting means 18 to a washing means 22. In the washing means 22 the particles are washed with a washing agent to remove excess wetting agent from the particles. The washing agent can also remove any wetting agent which can be entrained on the non-receptive surface portions of the particles. The washing means 22 can comprise a vibrating screen transporting the particles past a series of sprayers 24 which deliver the washing agent onto the particles.

The particle stream 26 exiting the washing means 22 contains a mixture of selected particles having a relatively large surface area receptive to coating by the preselected wetting agent and non-selected particles having a relatively small surface area receptive to coating by the preselected wetting agent. The stream of particles 26 is collected in a collecting means 28.

From the collecting means 28 the mixture of particles can be transferred to a subsequent separation process such as an optical separation process.

The invention is further illustrated by the following examples, which are not intended to be limiting.

EXAMPLE 1

A quantity of crushed ore containing limestone and granite is crushed to a particle size within the range of from about one-fourth inch to about eight inches. The average particle size of the mixture of ore is about one and one-half inches. The sized particulate ore is washed to remove any fines present in the ore mixture.

The washed and sized ore is fed onto a vibrating feeder that consists of a downwardly sloping flat table adaptable to vibrate. The vibrating feeder is adapted to provide a feed of falling particles to a conditioning zone positioned therebelow. Due to the vibration of the vibrating feeder, the mixture of particles tumbles off the edge of the vibrating feeder in a random free fall state.

The free falling particles pass downward through a conditioning zone. The conditioning zone is a plurality of sprayers which form a ring around the stream of falling particles. The direction of spray of the sprayers is inward toward the stream of falling particles.

A wetting agent which has an organic to aqueous ratio in the range of about 1:200 to about 1:20, e.g. 1:50, is prepared by forming a solution of fluoranthene in oleic acid and dispersing the solution in water. The fluoranthene is dissolved at a concentration of about 0.5 to 5 weight (e.g. 2%) in oleic acid. The aqueous dispersion containing oleic acid and the fluoranthene fluorescent dye is sprayed from the sprayers in the conditioning zone onto the mixture of particles as the particles fall through the conditioning zone.

This dispersion of oleic acid and water selectively adheres to the limestone exposed on the surface of the particles because of the surface chemical properties of the limestone. The granite exposed on the surface of the particles undergoes no reaction with, or coating by, the dispersions of oleic acid and water. Selected particles having a relatively large surface area of limestone receive a greater amount of coating than non-selective particles having a relatively small surface area of limestone.

The particles falling from the conditioning zone are collected on a screen. The excess wetting agent is separated from the falling stream of particles as the particles impinge upon the collecting screen. The excess wetting agent passes through the screen and is collected and recycled to the conditioning zone for spraying on other particles passing through the zone. The mesh of the collecting screen is sufficiently small to retain the particles falling thereon but is sufficiently large to allow the passage of excess wetting agent.

The particles are transported from the collecting screen onto a vibrating screen forming an endless conveyor belt. While on the vibrating screen, the particles are carried past a series of washing sprayers which spray a wash solution onto the particles. The wash solution substantially rinses remaining excess wetting agent from the particles.

The particles following the washing are collected for separation based upon differences between the amount of coated area on the particles using an apparatus such as the Mathews' apparatus as disclosed in U.S. Pat. No. 3,472,375 which is incorporated herein by reference.

EXAMPLE 2

The experiment of Example 1 is repeated in all essential details except the wetting agent is prepared by forming a dispersion of ARMEEN L-11 which is an amine reagent of the Armak Chemical Company in water. A fluorescent dye, fluoranthene, is dissolved in the amine in a concentration of about 2.5 percent by weight.

In the conditioning zone the granite exposed on the particle surface is substantially coated with the dispersion to the substantial exclusion of the limestone exposed on the particle surface.

The wetting agent coated particles are separated from the non-coated particles in an apparatus such as the Mathews' apparatus.

EXAMPLE 3

The experiment of Example 1 was repeated in all essential details except the feed material is a limestone ore containing limestone and chert.

The wetting agent was prepared by forming an aqueous dispersion of 2% of a solution of fluoranthene in ARMEEN L-11. The concentration of fluoranthene in the ARMEEN L-11 was about four percent by weight.

In the conditioning zone the exposed areas of chert on the particles are substantially coated to the substantial exclusion of exposed areas of limestone and particles are separated following wetting in apparatus such as the Mathews' apparatus.

The wash step described herein can also be effected in free fall through a plurality of spraying nozzle arrangements.

Each set of nozzles could dispense a different solution or a different concentration of solution. For example, the top-most set could dispense a surface active agent, the next lower set could dispense a dye solution and the next lower set, a rinse.

The apparatus and method described herein are especially useful in the process described in Ser. No. 897,740, filed on Apr. 19, 1978 by Brij M. Moudgil titled "Separation of Limestone from Limestone Ore," now U.S. Pat. No. 4,208,272, the entire disclosure of which is hereby incorporated herein.

What is claimed is:

1. Apparatus for conditioning a particle mixture comprising desired and undesired particles, for enabling optical distinction between the desired particles and the undesired particles said apparatus comprising:

(a) means for sizing said desired and undesired particles to a preselected size, said desired particles having a relatively large surface area receptive to coating by a preselected wetting agent and a relatively small surface area not receptive to coating by the preselected wetting agent, said undesired particles having a relatively small surface area receptive to coating by the preselected wetting agent, and a relatively large surface area not receptive to coating by the preselected wetting agent, said relatively large surface areas being optically distinguishable from said relatively small surface areas after being coated by the preselected wetting agent, (b) spray means, defining a conditioning zone, for impacting said desired and undesired particles with sufficient wetting agent to substantially coat all of the desired and undesired particles' surface areas receptive to coating by the wetting agent within the conditioning zone;

(c) feeding means for passing the particle mixture comprising the desired and undesired particles through the conditioning zone in a state of free fall;

(d) means for collecting the free-falling particles without substantial breakage thereof and for separating excess wetting agent therefrom, said means for collecting the free-falling particles including an inclined surface member having an impact absorbing material disposed therein;

(e) washing means for removing excess wetting agent from surface areas of the desired and undesired particles which are not receptive to coating by the wetting agent; and (f) means for supplying said excess wetting agent to the spray means.

2. The apparatus of claim 1 wherein the means for sizing includes a crusher and means for grading the desired and undesired particles to the preselected size.

3. Apparatus for conditioning a particle mixture comprising desired and undesired particles for enabling optical distinction between the desired particles and the undesired particles, said apparatus comprising:

(a) means for sizing said desired and undesired particles, said desired particles having a relatively large surface area receptive to coating by a preselected wetting agent and a relatively small surface area not receptive to coating by the preselected wetting agent, said undesired particles having a relatively small surface area receptive to coating by the preselected wetting agent and a relatively large surface area not receptive to coating by the preselected wetting agent;

(b) spray means defining a conditioning zone, for impacting said desired and undesired particles with sufficient wetting agent to substantially coat all of the desired and undesired particle surface areas receptive to coating by the preselected wetting agent within the conditioning zone;

(c) feeding means for passing the particle mixture comprising the desired and undesired particles through the conditioning zone in a state of free fall; and, (d) means, including an inclined surface member, for collecting the free-falling particles without substantial breakage thereof and for separating excess wetting agent therefrom.

4. The apparatus of claim 3 wherein the inclined surface member is coated with an impact absorbing material.

* * * * *